US010412992B2

(12) United States Patent
Fallon et al.

(10) Patent No.: US 10,412,992 B2
(45) Date of Patent: Sep. 17, 2019

(54) ADHESIVE TRANSFER SYSTEM

(71) Applicant: British American Tobacco (Investments) Limited, London (GB)

(72) Inventors: Gary Fallon, London (GB); Sam Whiffen, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 15/517,799

(22) PCT Filed: Sep. 29, 2015

(86) PCT No.: PCT/GB2015/052821
§ 371 (c)(1),
(2) Date: Apr. 7, 2017

(87) PCT Pub. No.: WO2016/055768
PCT Pub. Date: Apr. 14, 2016

(65) Prior Publication Data

US 2017/0238602 A1 Aug. 24, 2017

(30) Foreign Application Priority Data

Oct. 8, 2014 (GB) ..... 1417773.7

(51) Int. Cl.
*B05C 11/10* (2006.01)
*A24C 5/47* (2006.01)
(Continued)

(52) U.S. Cl.
CPC ..... *A24C 5/472* (2013.01); *B05C 1/006* (2013.01); *B05C 1/0808* (2013.01); *B05C 11/10* (2013.01)

(58) Field of Classification Search
CPC ..... A24C 5/472; B05C 11/10; B05C 1/006; B05C 1/0808; B05C 1/14; A24D 3/0216; A24D 3/022
(Continued)

(56) References Cited

U.S. PATENT DOCUMENTS 4,035,220 A 7/1977 Hammersmith
4,249,547 A 2/1981 Hinzmann
(Continued)

FOREIGN PATENT DOCUMENTS

CN 2607796 Y 3/2004
CN 2613155 Y 4/2004
(Continued)

OTHER PUBLICATIONS

Demand for International Preliminary Examination for corresponding application PCT/GB2015/052821 filed on Sep. 29, 2015; Report dated Aug. 8, 2016.
(Continued)

*Primary Examiner* — Laura Edwards
(74) *Attorney, Agent, or Firm* — Cantor Colburn LLP

(57) ABSTRACT

An adhesive transfer system for applying a pattern of adhesive to a web of tipping paper as it is being fed through a smoking article filter assembly unit including a transfer roller and an applicator roller, the transfer roller having an engraved pattern on its surface that corresponds to the pattern of adhesive to be applied to the tipping paper web, the applicator roller being nipped with the transfer roller so that adhesive received on its surface is transferred from said engraved region onto the applicator roller as the transfer roller and applicator roller rotate to form an adhesive pattern on the applicator roller for subsequent transfer onto a moving web of tipping paper in contact with said applicator roller, where the engraved pattern includes individual adhe-
(Continued)

sive containing cells to break up adhesive that coats the engraved region of the transfer roller.

4 Claims, 2 Drawing Sheets

(51) Int. Cl.
*B05C 1/08* (2006.01)
*B05C 1/00* (2006.01)

(58) Field of Classification Search
USPC ..... 118/259, 211, 212; 493/49; 131/90
See application file for complete search history.

(56) References Cited

U.S. PATENT DOCUMENTS

| | | | | |
|---|---|---|---|---|
| 4,252,527 | A | 2/1981 | Hall | |
| 4,282,889 | A | 8/1981 | Dahlgriin | |
| 4,295,478 | A | 10/1981 | Yeatts | |
| 4,301,583 | A * | 11/1981 | Poole | B41N 7/06 101/150 |
| 4,303,080 | A | 12/1981 | Boegli | |
| 4,361,156 | A | 11/1982 | Hall | |
| 6,810,227 | B2 * | 10/2004 | Sakata | G03G 15/0808 399/281 |
| 6,846,172 | B2 * | 1/2005 | Vaughn | B31F 1/07 101/23 |
| 2002/0053350 | A1 | 5/2002 | Tani | |
| 2004/0226465 | A1 | 11/2004 | Morke | |
| 2008/0160123 | A1 | 7/2008 | Spiers | |
| 2011/0185928 | A1 * | 8/2011 | Hendriks | B23K 26/0823 101/348 |
| 2013/0167849 | A1 | 7/2013 | Ademe | |
| 2013/0276966 | A1 | 10/2013 | Mikula | |
| 2015/0034100 | A1 | 2/2015 | Park | |

FOREIGN PATENT DOCUMENTS

| | | | |
|---|---|---|---|
| CN | 203314091 | U | 12/2013 |
| CN | 103781373 | A | 5/2014 |
| DE | 1296559 | | 5/1969 |
| DE | 19733446 | A1 | 2/1999 |
| EP | 0059042 | A1 | 9/1982 |
| EP | 0643928 | A1 | 3/1995 |
| EP | 2338359 | A1 | 6/2011 |
| EP | 2545791 | A1 | 1/2013 |
| EP | 2570041 | A1 * | 3/2013 |
| GB | 2100572 | A | 1/1983 |
| WO | 9011518 | A1 | 10/1990 |
| WO | 0076771 | A1 | 12/2000 |
| WO | WO-2013/165567 | * | 11/2013 |

OTHER PUBLICATIONS

International Preliminary Report of Patentability for corresponding application PCT/GB2015/052821 filed Sep. 29, 2015; dated Dec. 9, 2016.

International Search Report for corresponding application No. PCT/GB2015/052821 file Sep. 29, 2015; dated Jan. 14, 2016.

Written Opinion of the International Search Authority for corresponding application No. PCT/GB2015/052821 file Sep. 29, 2015; dated Jan. 14, 2016.

Chinese Office Action for corresponding application 201580054711.X filed Sep. 29, 2015; dated Aug. 3, 2018.

* cited by examiner

ADHESIVE TRANSFER SYSTEM

TECHNICAL FIELD

This invention relates to an adhesive transfer system for applying a pattern of adhesive onto a moving web of tipping paper that is being fed through an apparatus used to form smoking articles, such as filter cigarettes. The invention also relates to a smoking article filter assembly apparatus incorporating the adhesive transfer system of the invention.

BACKGROUND

Apparatus used in the assembly of smoking articles, such as filter cigarettes, includes a filter attachment unit for attaching a filter and a tobacco rod to each other to form a filter cigarette. A double length filter rod may be aligned with two tobacco rods, one at either end of the filter rod, and the three rods are wrapped with a patch of wrapping material known as a 'tipping paper' to join them together. The centrally positioned double length filter rod is then cut into two to form two filter cigarettes. The patch is attached to the filter and tobacco rod using adhesive applied to sections of a tensioned web of tipping paper using an adhesive transfer system as it moves through the apparatus, prior to cutting the web into patches. Depending on the construction of the smoking articles that are to be manufactured, adhesive often needs to be applied to discrete regions of the tipping paper surface and in a predetermined pattern.

SUMMARY OF THE INVENTION

In accordance with embodiments of the invention, there is provided an adhesive transfer system for applying a pattern of adhesive to a web of tipping paper as it is fed through a smoking article filter assembly unit, the system comprising a transfer roller and an applicator roller, the transfer roller having a plurality of engraved regions forming a pattern on its surface that corresponds to the pattern of adhesive to be applied to the tipping paper web, the applicator roller being nipped with the transfer roller so that adhesive received on its surface is transferred from said engraved regions onto the applicator roller as the transfer roller and applicator roller rotate to form an adhesive pattern on the applicator roller for subsequent transfer onto a moving web of tipping paper in contact with said applicator roller, said engraved regions each comprising a pluarilty of individual adhesive containing cells to break up adhesive over each of the engraved regions of the transfer roller.

In a preferred embodiment, each cell has a depth in the region of 30 microns. Preferably, each cell has a width in the region of 0.45 microns.

Each cell may be hexagonal in shape in a direction across the surface of the transfer roller.

In some embodiments, the system comprises a trough to contain a reservoir of adhesive, the transfer roller being positionable in the trough to pick up adhesive as the transfer roller rotates.

In other embodiments, the system comprises an adhesive applicator configured to supply adhesive under pressure to the surface of the transfer roller. Preferably, the adhesive applicator is positioned between the transfer and applicator roller to apply adhesive to the transfer roller at the nip between the transfer roller and the applicator roller.

According to another aspect, there is also provided a smoking article filter assembly apparatus comprising the adhesive transfer system according to the invention.

BRIEF DESCRIPTION OF THE DRAWINGS

Embodiments of the invention will now be described, by way of example only, with reference to the accompanying drawings, in which.

DETAILED DESCRIPTION

As used herein, the term 'smoking article' includes smokeable products such as cigarettes, cigars and cigarillos whether based on tobacco, tobacco derivatives, expanded tobacco, reconstituted tobacco or tobacco substitutes and also heat-not-burn products and other nicotine delivery product such as aerosol generation devices including e-cigarettes. The smoking article may be provided with a filter for the gaseous flow drawn by the smoker. Whilst not all smoking articles have a filter, embodiments of the present invention relate to smoking articles that are provided with a filter for the gaseous flow drawn by the smoker and which is attached to a tobacco rod in a cigarette filter assembly apparatus using tipping paper.

Figure 1:
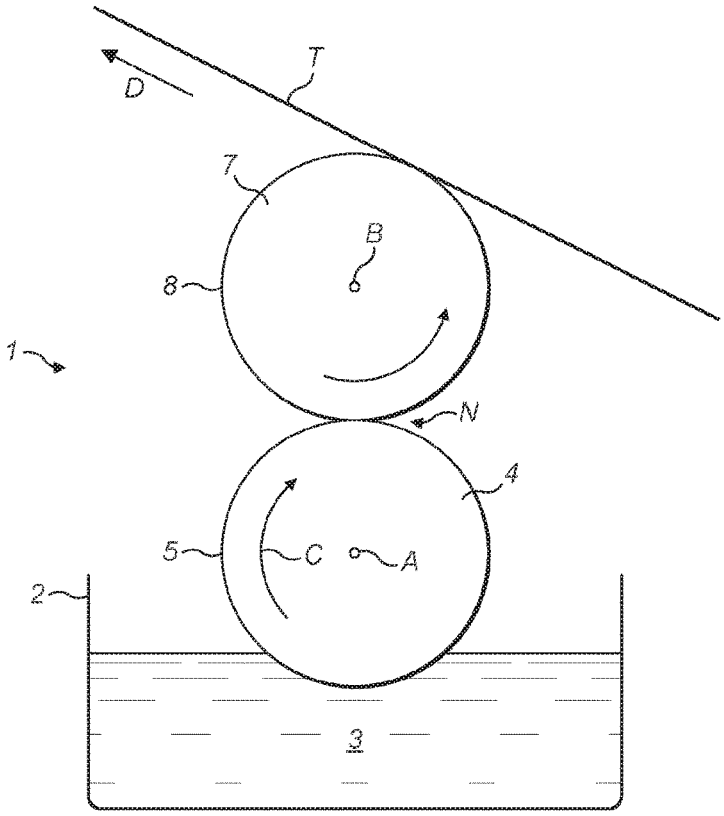
FIG. 1 shows a side elevation of an adhesive transfer system according to an embodiment of the present invention.

An adhesive transfer system 1, which forms part of a cigarette filter assembly apparatus (not shown) is illustrated in FIG. 1. The adhesive transfer system 1 includes a trough 2 containing a reservoir 3 of adhesive and a transfer roller 4 which is mounted for rotation in direction 'C' about an axis 'A' above the trough 2 and has a curved, circumferential outer surface 5. The transfer roller 4 projects into the reservoir 3 so that its curved surface 5 is partially immersed in the adhesive 3 received in the trough 2. During operation, the transfer roller 4 is rotated in a synchronised manner with other components of the cigarette filter assembly apparatus, such as the tipping paper web feeding mechanism (not shown).

The curved surface 5 of the transfer roller 4 is engraved or etched with a cell-like pattern 6 (see FIG. 2) that corresponds to the pattern of glue that is to be applied to the tipping paper web (T). As the transfer roller 4 rotates, the curved surface 5 of the transfer roller 4 is coated with adhesive picked-up from the reservoir 3, which also fills the engraved regions 6 on the transfer roller 4.

In known adhesive transfer systems, the tipping paper web (T) lies in direct contact with the transfer roller 4, and excess adhesive on the transfer roller 4 is removed from the surface of the transfer roller 4 prior to contact with the tipping paper web (T), other than from the engraved regions 6, by a doctor blade pressed against the curved surface 5 of the transfer roller 4. Adhesive is then pulled out of the engraved regions 6 onto the tipping paper web (T) due to surface tension forces generated on the adhesive by the tipping paper (T) passing over it.

As the tipping paper web (T) is thin and relatively weak, the surface tension that is generated may not be sufficient to ensure that all the adhesive is pulled out of the engraved regions 6 of the transfer roller 4 onto its surface, or too much of the adhesive may be applied to a concentrated area of the overall pattern and none or little is applied to other areas of the overall pattern. Thus, the transfer of adhesive to the tipping paper web (T) is poor and inconsistent.

Proper and consistent application of adhesive to the tipping paper web (T) is important. As the tipping paper web (T) is thin, it has a low tensile strength and can break easily, especially when it is being fed through the filter assembly apparatus at a relatively fast speed. If the tipping paper web (T) becomes wetted by too much adhesive concentrated over a small area, then the tensile strength of the web in that area is reduced further, resulting in breakages occurring more easily. Furthermore, too much adhesive applied to one concentrated region of the tipping paper web (T) can result in the adhesive bleeding through the thickness of the tipping paper web (T) ruining its appearance.

Embodiments of the present invention employ a twin-roller glue transfer system. More specifically, an applicator roller 7 is mounted above the transfer roller 4, with its axis of rotation 'B' parallel to the axis of rotation 'A' of the transfer roller 4. The applicator roller 7 may be geared to the transfer roller so that the applicator roller 7 is driven off the transfer roller 4 and they rotate together at the same speed. The curved surface 8 of the applicator roller 7 is smooth and presses against the curved surface 5 of the transfer roller 4 at a nip region (N) so that, as the transfer and applicator rollers 4, 7 rotate, glue is transferred from the engraved regions 6 of the transfer roller 4 onto the curved surface 8 of the applicator roller 7, so that the required pattern of adhesive is transferred onto the curved surface 5 of the applicator roller 7.

Due to the pressure between the transfer and applicator roller 4,7 at the nip (N), adhesive on the surface 5 of the transfer roller 4 other than in the engraved regions 6 is squeezed off the transfer and applicator rollers 4,7 and does not pass through the nip (N). This leaves an adhesive pattern corresponding to the shape of the engraved region 6 remaining on the smooth, curved surface 8 of the applicator roller 7.

The surface of the tensioned tipping paper web (T) to which adhesive is to be applied, is fed along a path, in the direction of arrow 'D', that results in the tipping paper web (T) coming into contact with the curved surface 8 of the applicator roller 7 in a position spaced from the nip (N) so that, as the applicator roller 7 continues to rotate, the adhesive pattern on the applicator roller 7 is subsequently transferred onto the surface of the tipping paper web (T) in the predetermined pattern.

As the adhesive pattern lies on a surface 8 of the applicator roller 7, it is effectively wiped off the surface 8 by the tipping paper web (T) in contact with the surface 8, and so the generation of sufficient surface tension to enable the tipping paper web (T) to pull the the adhesive out of engraved region is no longer a factor in the proper and consistent transfer of the adhesive to the tipping paper web (T) from the applicator roller 8.

Figure 2:
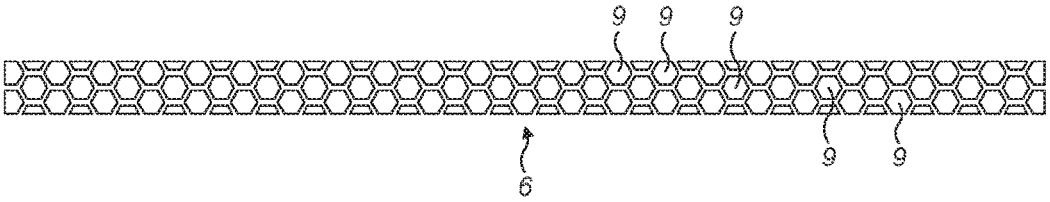
FIG. 2 shows an enlarged view of the cell-like structure that forms an engraved region on the transfer roller of the adhesive transfer system illustrated in FIG. 1.

It will be appreciated that the applicator roller 8 is required to generate sufficient and consistent surface tension at the nip (N) with the transfer roller 4 in order to ensure proper and effective transfer of adhesive from the engraved regions 6 of the transfer roller 4 onto the curved surface 8 of the applicator roller 7. This is achieved by breaking up the engraved region into a cell-like structure, as shown in FIG. 2, so that discrete amounts of adhesive picked up from the reservoir 3 are held in individual cells 9 within the engraved region, rather than as a single mass extending across the engraved region 6, across which the surface tension at the nip (N) may vary. By breaking the adhesive up so that it fills individual cells 9 across the engraved region, a much more consistent surface tension is generated at the nip (N), because the surface tension is substantially the same for each cell 9 irrespective of its position across the engraved region. This results in a much more uniform and consistent transfer of adhesive from the cells onto the applicator roller. Each cell 9 preferably has a depth in the region of 30 microns and a width W of 0.45 microns. The distance D between adjacent cells may be in the order of 0.1 microns.

Figure 3:
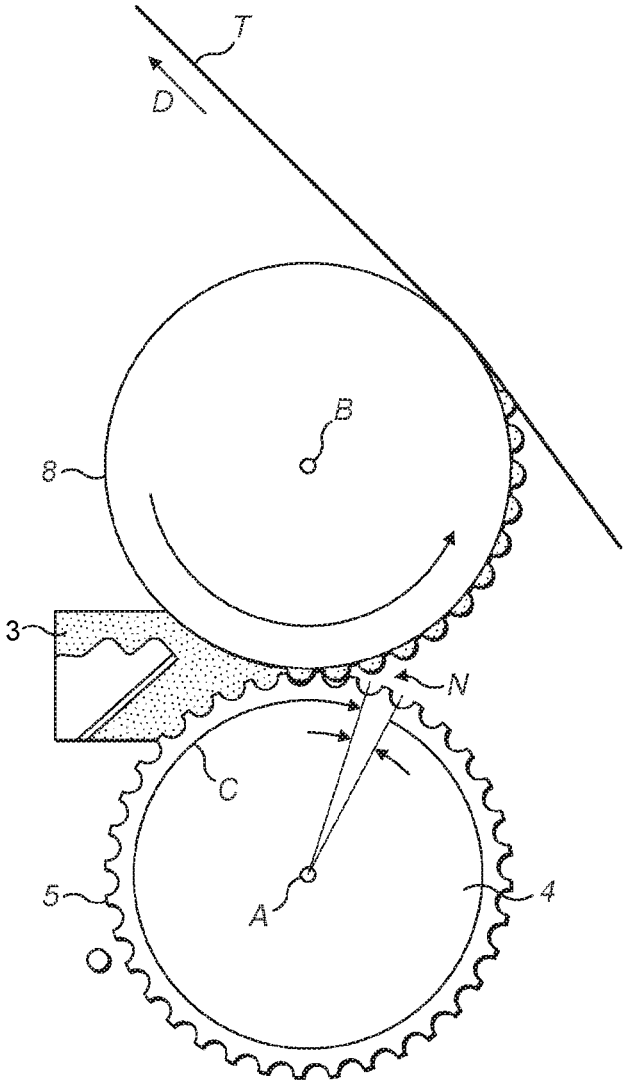
FIG. 3 shows a side elevation according to a modified embodiment.

In a modified embodiment, as shown in the side elevation of FIG. 3, the trough 2 is replaced with an adhesive reservoir 3 that is held under pressure and located close to the nip (N) between the transfer and applicator rollers 4,7, so that adhesive is supplied to the engraved regions 6 of the transfer roller 4 under pressure. This has the advantage that the adhesive travels over a shorter distance to reach the tipping paper web (T) than in the previous embodiment.

In order to address various issues and advance the art, the entirety of this disclosure shows by way of illustration various embodiments in which the claimed invention(s) may be practiced and provide for a superior adhesive transfer system. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smoking article filter assembly apparatus comprising an adhesive transfer system for applying a pattern of adhesive to a web of tipping paper as it is being fed through said apparatus, the system comprising a transfer roller having a curved surface, an applicator roller, and a trough to contain a reservoir of adhesive, the transfer roller being positionable such that its curved surface is partially immersed in said reservoir of adhesive, said curved surface having a plurality of engraved regions and non-engraved regions, said engraved regions forming a pattern on said curved surface that correspond to the pattern of adhesive to be applied to the tipping paper web, the applicator roller being nipped with the curved surface of the transfer roller at a nip so that adhesive received on the engraved regions is transferred from said engraved regions onto the applicator roller at the nip as the transfer roller and applicator roller rotate, the applicator roller being nipped with the transfer roller at a pressure such that adhesive received on said non-engraved regions is squeezed off the transfer and applicator rollers without passing through the nip, wherein the adhesive transferred from the engraved regions onto the applicator roller forms an adhesive pattern on the applicator roller which corresponds to the pattern of adhesive to be applied to a moving web of tipping paper in contact with said applicator roller, said engraved regions on the transfer roller each comprising a plurality of individual adhesive containing cells, the cells configured to break up adhesive over each of the engraved regions of the transfer roller.

2. A smoking article filter assembly apparatus according to claim 1, wherein each cell has a depth of about 30 microns.

3. A smoking article filter assembly apparatus according to claim 1, wherein each cell has a width of about 0.45 microns.

4. A smoking article filter assembly apparatus according to claim 2, wherein each cell is hexagonal in shape in a direction across the surface of the transfer roller.

* * * * *